United States Patent [19]

Forrer

[11] Patent Number: 4,797,024

[45] Date of Patent: Jan. 10, 1989

[54] ABRASIVE RESISTANT PAVEMENT MARKER

[75] Inventor: Douglas S. Forrer, Heath, Ohio

[73] Assignee: Pac-Tec, Inc., Newark, Ohio

[21] Appl. No.: 151,464

[22] Filed: Feb. 2, 1988

Related U.S. Application Data

[62] Division of Ser. No. 912,521, Sep. 29, 1986, Pat. No. 4,753,548.

[51] Int. Cl.[4] ..... E01F 9/06

[52] U.S. Cl. ..... 404/16; 264/1.4; 264/1.9; 427/44; 427/54.1; 427/163; 29/451

[58] Field of Search ..... 264/1.7, 1.9, 129, 1.4; 427/54.1, 163, 162, 44; 404/14, 15, 16; 29/451

[56] References Cited

U.S. PATENT DOCUMENTS

| | | | |
|---|---|---|---|
| 3,409,344 | 11/1968 | Balint et al. | 404/14 X |
| 4,199,421 | 4/1980 | Kamada et al. | 427/54.1 X |
| 4,234,265 | 11/1980 | Otis | 404/16 |
| 4,250,646 | 2/1981 | Trachtenberg | 40/582 |
| 4,477,528 | 10/1984 | Frye | 427/163 |
| 4,498,733 | 2/1985 | Flanagan | 404/14 X |
| 4,596,622 | 6/1986 | Heenan et al. | 156/275.5 |
| 4,659,248 | 4/1987 | Flanagan | 404/16 X |
| 4,717,281 | 1/1988 | Shepherd et al. | 404/16 |
| 4,725,494 | 2/1988 | Belisle et al. | 427/137 |

*Primary Examiner*—Jerome W. Massie
*Assistant Examiner*—Matthew Smith
*Attorney, Agent, or Firm*—Reising, Ethington, Barnard, Perry & Milton

[57] ABSTRACT

A pavement marker for roadway surface including a housing 12 having a lower base portion 14 and at least one wall 18 extending substantially upwardly from the base portion 14. A retroreflective lens 20 is mounted on the wall 18 and has a front surface 22 facing away from the wall 18. A photopolymerizable clear acrylic protective hard coat is deposited over the front face of the lens for resisting abrasion of the lens and reducing the loss of optical efficiency resulting from such abrasion.

A method of making the pavement marker includes the steps of forming the lens 20 having the front face 22, coating the front face 22 of the lens 20 with a photopolymerizable acrylic composition, irradiating the coating with ultraviolet or electron beam irradiation to cure the acrylic composition to an abrasion resistant coating 24, and mounting the lens 20 in the housing 12 to dispose the coated front face 22 away from the housing 12.

7 Claims, 2 Drawing Sheets

ABRASIVE RESISTANT PAVEMENT MARKER

This is a division, of application Ser. No. 912,521, filed on 9-29-86, U.S. Pat. No. 4,753,548 issued 6-28-88.

TECHNICAL FIELD

This invention relates to roadway reflectors and particularly to roadway reflectors that are adapted to be mounted on a roadway to reflect light from the headlight of an oncoming automotive vehicle and thereby delineate the traffic lanes of the road to the driver of the vehicle.

BACKGROUND ART

Reflective roadway markers are used by highway departments for delineating highway lines on pavement. Reflective markers are clearly visible at night by reflecting the light from oncoming vehicles back to the vehicle. Generally the markers include a body supporting some sort of a reflective lens.

The U.S. Pat. No. 3,409,344 to Balint et al, issued Nov. 5, 1968 discloses a roadway marker including a housing and reflective inserts, the inserts having substantially flat outer surfaces and a plurality of retro-reflective prisms on the inner surfaces thereof. The inner surfaces of the prisms are coated with a metalized layer and the entire housing is filled with a plastic material to provide strength and rigidity to the marker.

The U.S. Pat. No. 3,332,327 to Heenan, issued July 25, 1967, discloses a pavement marker adapted to be placed on highways. The pavement marker has a front face and is inclined at a predetermined angle to the roadway surface so that a self-cleaning effect is provided by virtue of that predetermined angle.

It has further been found that the angle that the reflective lens makes in relation to the pavement surface also maximizes the reflective efficiency of such a retro-reflective prism surface.

As disclosed in the Heenan '327 patent, as well as the U.S. Pat. No. 4,340,319 to Johnson et al, mechanical abrasion decreases when the angle of the front face of the lens portion of the pavement marker is increased. However, as that angle increases, the cleaning action obtained by a tire wiping on the front face of the lens decreases. There is an optimum range for optical effectiveness when the angle of the front face of the lens member is disposed at 30° to the horizontal, with the satisfactory result being obtained where such an angle is between 15° and 45°.

It is further noted in the Johnson et al '319 patent that when such pavement markers are used in areas where abrasive materials such as salt are deliberately distributed over the roadway surface during the winter months, the abrasion problem becomes particularly acute. As soft plastic lenses are generally used with fine optical quality, the lenses are highly susceptable to abrasion. Sand and salt are continually brought into contact as the wiping action of the vehicle tires, combined with the abrasive materials, tend to scratch and grind the front face of the lens and diminish optical effectiveness and reflective quality of the pavement marker.

The Johnson et al '319 patent attempts to solve the problem by providing a layer of untempered glass sheet fixedly disposed on the light receiving and refracting portion of the lens. The glass is in compression throughout the expected temperature range to which the pavement marker is exposed and used. The Johnson et al '319 patent utilizes glass because, as is expressly stated in the Johnson et al patent, other coatings on the plastic lens have failed to provide the necessary abrasion resistance or have required curing temperatures which were so high that they distorted the plastic material of the reflector, thereby resulting in a serious deterioration of the reflector optics. Rather than using a polymer system requiring curing, the Johnson et al patent utilizes glass adhered to the lens.

This invention provides another alternative to solving the problem. A polymer coating is chemically bonded to the plastic front face of the lens which provides a hard, smooth surface and does not require high curing temperatures. Rather, this invention provides a polymer system which requires no heat thereby solving the problems of a high temperature cure.

SUMMARY OF THE INVENTION

The present invention provides a pavement marker for a roadway surface including housing means having a lower base portion and at least one wall extending substantially upwardly from the base portion and a retro-reflective lens mounted on the wall. The retro-reflective lens has a front surface facing away from the wall. Abrasion resistant means are deposited over the lens for resisting abrasion of the lens and reducing the loss of optical efficiency resulting from such abrasion. The invention is characterized by the abrasion resistant means including a photopolymerizable clear acrylic hard coat.

The present invention further provides the method of making the pavement marker including the steps of forming the lens having the front face, coating the lens with a photopolymerizable acrylic composition, irradiating the coating with ultraviolet or electron beam radiation to cure the acrylic composition to an abrasion resistant protective coating, and mounting the lens in a housing to dispose the coated front face away the housing.

FIGURES IN THE DRAWINGS

Other advantages of the present invention will be readily appreciated as the same becomes better understood by reference to the following detailed description when considered in connection with the accompanying drawings wherein.

DETAILED DESCRIPTION OF THE DRAWINGS

A pavement marker constructed in accordance with this invention is generally shown at 10. The pavement marker includes a housing generally indicated at 12. The housing 12 includes a lower base portion 14 which is adapted to be adhered to a roadway surface 16. The housing 12 is hollow and includes sidewalls 18 extending substantially upwardly from the base portion 14.

Figure 1:
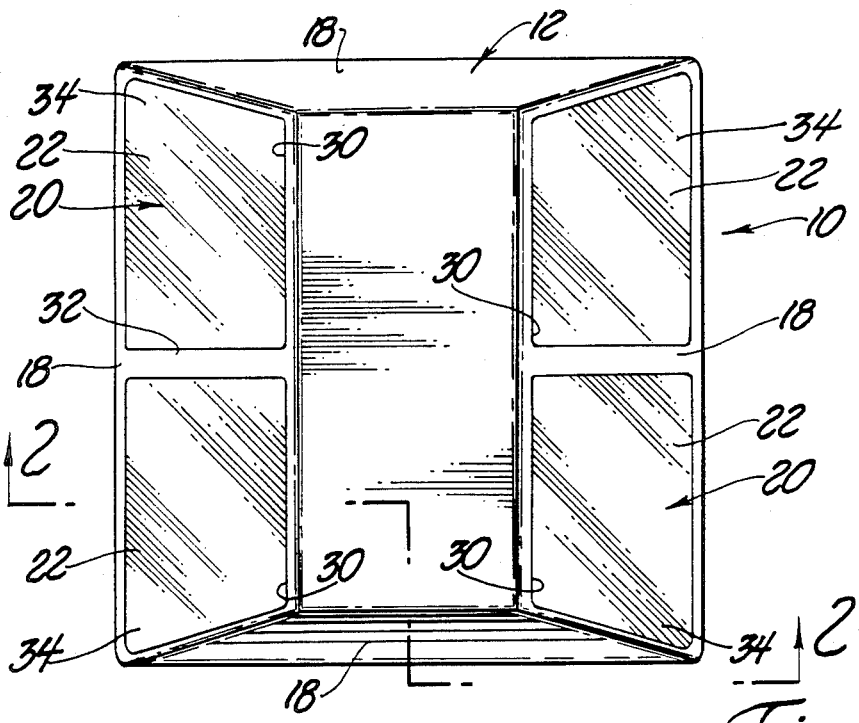
FIG. 1 is a top plan view of a roadway reflector embodying the invention.
Figure 2:
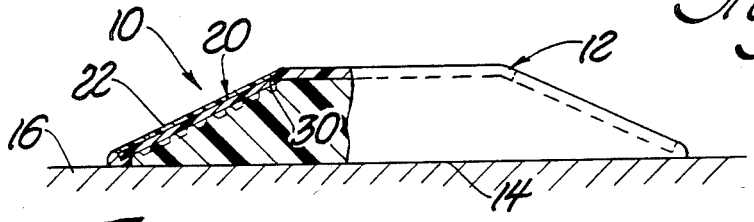
FIG. 2 is a cross section view taken substantially along lines 2—2 of FIG. 1.
Figure 3:
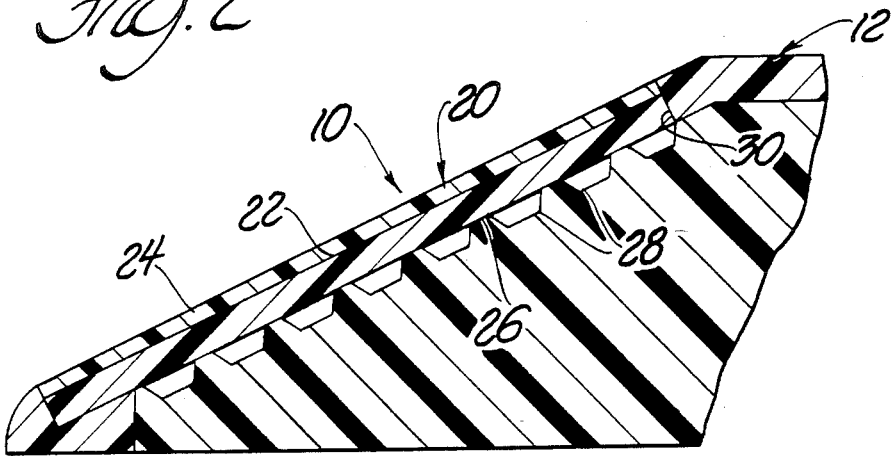
FIG. 3 is an enlarged cross sectional view of the lens mounted on the housing.

A retro-reflective lens generally indicated at 20 is mounted on at least one of the walls 18 and has a front surface 22 facing away from the wall 18. The marker can include two walls supporting lenses thereby providing a front and rear reflective marker. As best shown in FIG. 3, abrasion resistant means 24 is deposited over the lens 20 for resisting abrasion of the lens 20 and reducing the loss of optical efficiency resulting from such abrasion. The invention is characterized by the abrasion resistant means 24 including a photopolymerizable acrylic protective hard coat.

By being photopolymerizable, the invention provides a hard acrylic coating which does not require heat for curing. The curing of the abrasion resistant means of this invention does not adversely effect the optical quality of the lens 20 thereby not having those problems of other polymer coatings previously recognized in the Johnson et al '319 patent.

The protective hard coat is chemically adhered and integral with the front surface of the lens 20. As the front face of the lens 20 is made of an acrylic resin, the hard coat bonds to and becomes substantially homogenous at the interface with the front face of the lens 20. This is done without loss of reflective efficiency as indicated by the examples shown in Table 1.

Referring to FIG. 3, the lens 20 includes a rear face 26 having reflex-reflector means 28 on at least a portion thereof for reflecting light transmitted through the front face 22 back toward the source thereof. The function of these reflectors are discussed in detail in the Balint et al '344 patent.

More specifically, the wall 18 upon which the reflector 20 is mounted defines a first plane. The reflex-reflective means includes a plurality of prisms 28 forming an angle with the plane of the wall 18. The base portion 14 of the housing 12 defines a second plane. The wall 18 has a plurality of recesses 30 therein forming a web 32 therebetween. The lens 20 is an insert having spaced portions 34 and a web 36 connecting the spaced portions and underlying the web 32 of the wall 18. The insert 20 is bonded in the recesses 30 to the wall 18 in such a position that the prisms 28 extend at an acute angle to the plane of the wall 18 and at an acute angle also to the second plane defined by the base portion 14.

The resulting roadway marker has the prisms of the reflector therein forming an angle with the plane of the roadway such that the light beam of an oncoming automotive vehicle will be reflected back to the eyes of the driver.

The hard coat includes acrylates and/or diacrylates, a stabilizer, and a solvent for dissolving the components and being curable by exposure to electron beam irradiation. Alternatively, a photoinitiator such as benzophenone may be added to the composition and the composition can then be cured by ultraviolet irradiation. In either situation, the cure can be accomplished after air drying five minutes with minimal or no heat thereby not exposing the plastic lens to the distorting influence of heat. Ultraviolet irradiation may be accomplished with a 200 watt/inch lamp.

Other photoinitiators may be used. Preferably, the composition includes a dual package initiator comprising benzophenone and 1-hydroxycyclohexyl phenyl ketone in equal parts. The photoinitiator system is sold under the trade name of Irgacure 500 by Ceiba Geigy. The photoinitiator is preferably 2 parts per hundred of the final composition by weight but may be varied as much as 20% to 30%.

Preferably, the acrylics are a mixture of di-pentaerithritol hydroxypenta acrylate and 1-6 hexanediol diacrylate. The acrylate imparts hardness to the final hard coat. Preferably the hard coat comprises 32 parts per hundred of the composition by weight. This may be varied by 15% to 20%. The diacrylate imparts flexibility to the finally cured polymer while also providing viscosity reduction to the combined batch prior to curing. Preferably, the composition includes 8 parts per hundred by weight of the diacrylate. This amount can be varied by 15% to 20%.

The stablizer prevents ultraviolet irradiation from the sun from degrading the hardcoat. Such irradiation could otherwise yellow the hardcoat and effect optical efficiency. Light induced oxidation can be responsible for damage to the polymeric materials absent a stabilizer. On the other hand, the stabilizer counters the curing if accomplished by ultraviolet irradiation. Hence, tight control of the quantity of the stabilizer must be maintained. Substituted 2-($2^1$-hydroxyphenyl) benzotriazoles and hindered amines may be used.

The preferred stabilizers are a mixture of Tinuvin 292 sold by Cieba Geigy as a hindered amine stabilizer and a substituted benzotriazole stablizer. Each stablizer is preferably 0.2 parts per hundred and may be varied by no more than 5%.

Preferably, the composition also includes a non-hydrolyzable silicone glycol copolymer to provide water repellancy to the hardcoat and surface smoothness. The hardcoat thereby provides a water tight seal over the lens 20. The non-hydrolyzable silicone glycol copolymer may be purchased from Bichemical of West Germany as BYK301.

A flourochemical surfactant is preferably included in the composition to enhance surface wetness during application of the composition to the lens 20. Preferably FC430 made by 3M Corporation is utilized.

The solvent is selected to provide a solution of the mixture of solid polymers and stablizers. Preferably, the composition includes a mixture of methyl ethyl ketone and isobutyl isobutyrate.

In the preferred embodiment of the invention, the hard coat has the following formulation:

| COMPONENTS | PARTS PER 100 BY WEIGHT |
|---|---|
| Di Pentaerithritol Hydroxypenta Acrylate | 32.0 |
| 1,6 Hexanediol Diacrylate | 8.0 |
| Hindered Amine Stabilizer | 0.2 |
| Substituted Benzotriazole Stabilizer | 0.2 |
| Non-hydrolyzable Silicone Glycol Copolymer | 0.2 |
| Flourochemical Surfactant | 0.2 |
| Benzophenone | 1.0 |
| 1-Hydroxycyclohexyl Phenyl Ketone | 1.0 |
| Methyl Ethyl Ketone | 37.2 |
| Isobutyl Isobutyrate | 20.0 |

The composition has the following physical constants:

| | |
|---|---|
| Solids By Weight 40 | Weight Per Gal. 7.847 |
| Specific Gravity .942 | |
| Package Viscosity 14.5 | seconds zahn No. 2 |
| Flashpoint 20° F. | |

The composition is clear and UV curable after drying 5 minutes under a 200 watt/inch ultraviolet lamp.

Figure 5:
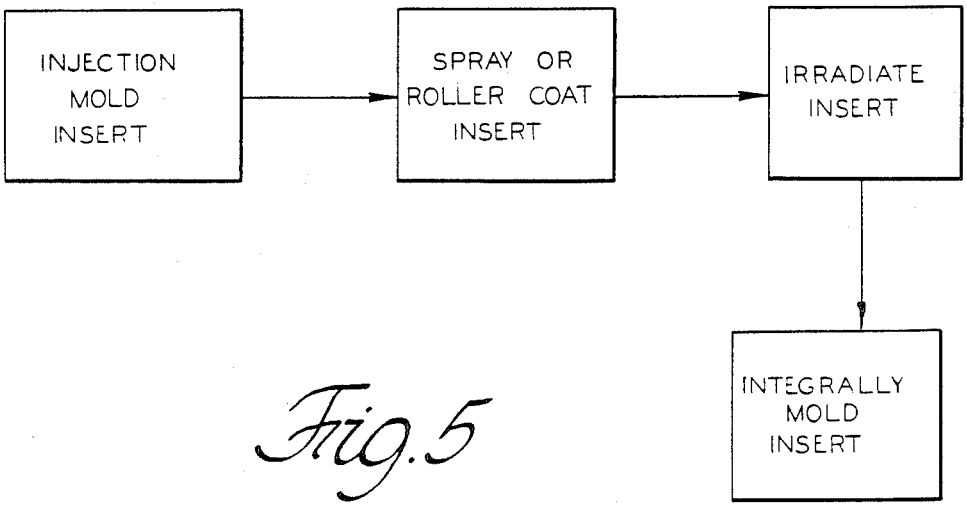
FIG. 5 is a schematic depiction of the method of making the invention.

The present invention further provides a method of making a pavement marker as schematically indicated in FIG. 5. The method includes the steps of first forming a lens 20 having a front face 22, coating the lens 20 with the photopolymerizable acrylic composition, and then irradiating the coating with ultraviolet or electron beam radiation to cure the acrylic composition to an abrasion resistant clear protective coating 24. The lens 20 is then mounted in the housing 12 to dispose the coated front face 22 away from the housing 12.

Figure 4:
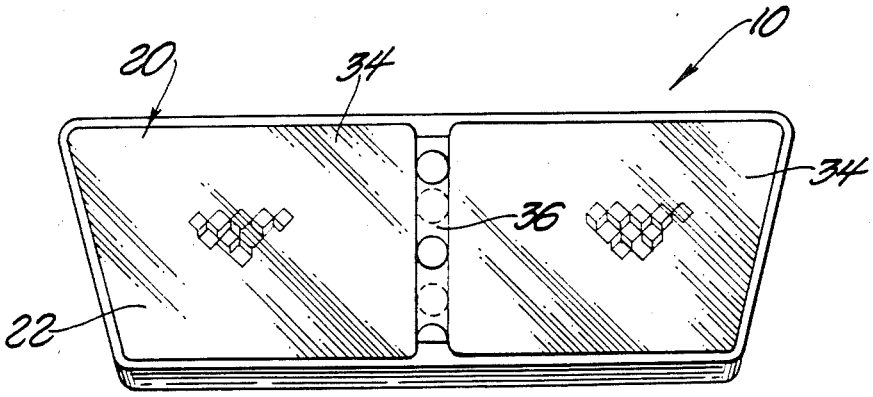
FIG. 4 is a top plan view of a reflective insert utilized in the roadway reflector shown in FIG. 1.

As schematically outlined in FIG. 5 ,the lens 20 is injection molded as an insert shown in FIG. 4 from an acrylic resin. The coating 24 is then adhered to the front face 22 of the insert 20 during application and curing. The coating may be applied by either spraying or roller coating the insert after it is injection molded.

Prior to or after coating of the front face 22 of the insert 20, a metallic layer is deposited on the rear face 26 of the lens 20. As disclosed in the Balint et al '344 patent, the housing 12 is then injection molded about the coated lens 20 to form an integral lens in housing unit.

Alternatively, the lens 20 and housing shell 12 may be molded at the same time, thereby providing an integral unit. The coating and metallic layer are then applied prior to filling or potting the hollow housing shell.

In another alternative embodiment, the housing may be constructed as a two piece structure. The coating and metalizing steps are preformed before the two housing halves are glued together and filled.

Of course, the inventive coating may be applied to lens of other types of pavement markers which may or may not be integrally molded with the housing.

EXAMPLES

Table 1 illustrates the results of an experiment conducted to show the abrasion resistance and optical integral of the present invention.

TABLE 1

| Marker | Reflectivity Before Abrasion | Reflectivity After Abrasion |
|---|---|---|
| 1 | 4.5 | 4.0 |
| 2 | 3.4 | 3.3 |
| 3 | 4.4 | 3.9 |
| 4 | 8.5 | 0 |
| 5 | 9.1 | 0 |

Lenses 1, 2 and 3 were coated with the preferred embodiment of the inventive hard coat. Lenses 4 and 5 were coated with Teflon adhesive spray camie formula number 2000. Type E markers manufactured by the assignee of this application were used. These are clear lenses.

Table 1 indicates the reflectivity of the lenses before abrasion in terms of candle power and reflectivity after abrasion. Abrasion was accomplished by a steel wool abrasion procedure wherein a steel wool pad was placed on the reflector lens and a fifty pound load was applied and the entire lens surface was rubbed 100 times. This abrasion test corresponds to many of the state requirements for pavement marker lens.

As shown in Table 1, the lenses coated with the inventive coating retain reflectivity after abrasion which is significantly higher than that required by all state specifications. The Teflon coating retained no reflectivity after abrasion.

In view of the above, the present invention provides a durable hard coat to a pavement marker which qualifies under all state specifications for abrasion resistance.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A method of making a pavement marker (10) including the step of: forming a lens (20) having a front face (22); adhering and integrally incorporating a photo polymerizable acrylic composition to the lens; and irradiating said coating with ultraviolet or electron beam irradiation to cure said acrylic composition to an abrasion resistant protective hardcoat capable of abrasion resistance while simultaneously retaining reflectivity of the underlying lens.

2. A method as set forth in claim 1 further including the step of mounting the lens (20) in a housing (12) to dispose said coated front face (22) away from the housing (12).

3. A method as set forth in claim 2 further defining the forming step as injection molding the lens (20) as an insert from an acrylic resin and chemically adhering the coating to the front face (22) of the insert (20).

4. A method as set forth in claim 3 wherein the lens (22) has a rear face (26) and said forming step is further defined by depositing a metallic layer on the rear face (26) of the lens (20).

5. A method as set forth in claim 4 wherein injection molding the housing (12) about the coated lens (20) to form an integral lens and housing unit.

6. A method as set forth in claim 1 further including the step of simultaneously molding the lens (20) and housing (12) and then applying the coating of the lens (20).

7. A method as set forth in claim 1 further including the steps of simultaneously molding the lens (20) and a housing half, coating the lens (20), and connecting housing half to a second housing half having a coated lens (20).

* * * * *

UNITED STATES PATENT AND TRADEMARK OFFICE
Certificate

Patent No. 4,797,024 Patented: January 10, 1989

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Douglas S. Forrer, Heath, OH; and James E. Fleischer, Evansville, IN.

Signed and Sealed this Eighth Day of April 2003.

DAVID J. BAGNELL
*Supervisory Patent Examiner*
Art Unit 3672